US006840412B2

(12) United States Patent
Damrath et al.

(10) Patent No.: US 6,840,412 B2
(45) Date of Patent: Jan. 11, 2005

(54) APPARATUS FOR PRESSING SHIRTS

(75) Inventors: Joachim Damrath, Bachhagel (DE); Kathrin Redlin, Berlin (DE); Markus Spielmannleitner, Ellwangen (DE); Bodo Urich, Berlin (DE); Gerhard Wetzl, Sontheim (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 10/600,406

(22) Filed: Jun. 20, 2003

(65) Prior Publication Data

US 2004/0011832 A1 Jan. 22, 2004

Related U.S. Application Data

(63) Continuation of application No. PCT/EP01/13978, filed on Nov. 29, 2001.

(30) Foreign Application Priority Data

Dec. 20, 2000 (DE) ..... 100 63 669

(51) Int. Cl.[7] ..... D06C 15/00

(52) U.S. Cl. ..... 223/57; 223/67; 223/70; 223/73

(58) Field of Search ..... 223/57, 67, 70, 223/73, 72, 74; 38/84, 85, 14; 100/73

(56) References Cited

U.S. PATENT DOCUMENTS

| | | | | | |
|---|---|---|---|---|---|
| 2,284,232 A | * | 5/1942 | Richa | ..... | 223/57 |
| 2,667,291 A | * | 1/1954 | Petrich | ..... | 223/70 |
| 3,595,450 A | | 7/1971 | Sclemon et al. | | |
| 4,303,183 A | * | 12/1981 | Schlemon | ..... | 223/67 |

* cited by examiner

*Primary Examiner*—John J. Calvert
*Assistant Examiner*—James G Smith
(74) *Attorney, Agent, or Firm*—Laurence A. Greenberg; Werner H. Stemer; Ralph E. Locher

(57) ABSTRACT

Pressing of shirts on a shirt-shaped outer inflatable body advantageously takes place with tensioning the shirt in flat form. To achieve a non-round cross-section, in particular, in the trunk section of the outer body, a supporting framework and at least one inner inflatable body are disposed within the outer body, it being possible for the inner body to be supported on the supporting framework and to subject the outer body to pressure from the inside. For such a purpose, the inner inflatable bodies are inflated, in particular, by a higher pressure than the outer inflatable body. It is, thus, possible for the trunk region to be tensioned laterally outward and for the shirt to be pressed in an advantageously flat form. Using the inner bodies avoids raised edges or sharp points in the enclosure of the outer inflatable body. As a result, the shirts can be pressed without creases.

11 Claims, 2 Drawing Sheets

APPARATUS FOR PRESSING SHIRTS

CROSS-REFERENCE TO RELATED APPLICATION

This application is a continuation of copending International Application No. PCT/EP01/13978, filed Nov. 29, 2001, which designated the United States and was not published in English.

BACKGROUND OF THE INVENTION

FIELD OF THE INVENTION

The invention relates to an apparatus for pressing shirts having a flexible outer inflatable body and a fan.

German Published, Non-Prosecuted Patent Application DE 196 07 260 A1 discloses a pressing appliance with a shirt-form inflatable body that, for the purpose of pressing a shirt fitted onto the shirt-form inflatable body, can be inflated by heated air. In such a case, however, the various sections of the shirt-form inflatable body inflate to form round cross-sections. Because a shirt that is to be pressed, on account of the build of the human body, is cut flat, in particular, in the trunk region, the round-shaped inflation of the inflatable body at these locations results in creases, which impair the pressing result.

SUMMARY OF THE INVENTION

It is accordingly an object of the invention to provide an apparatus for pressing shirts that overcomes the hereinafore-mentioned disadvantages of the heretofore-known devices of this general type and that improves the pressing results as compared to the apparatus mentioned above.

With the foregoing and other objects in view, there is provided, in accordance with the invention, an apparatus for pressing shirts, including a flexible outer inflatable body, a fan communicating at least with the outer inflatable body for inflating the outer inflatable body at a given pressure, a supporting framework, and at least one inner inflatable body being disposed within the outer inflatable body, being inflated at a pressure higher than the given pressure in an inflated state of the at least one inner inflatable body, being disposed between the supporting framework and a section of the outer inflatable body, and in an inflated state, being supported against the supporting framework and, in the inflated state, subjecting a section of the outer inflatable body to pressure from inside the outer inflatable body.

The inner inflatable bodies can be used to influence the shape of the outer inflatable body, the compressive forces to which the outer inflatable body is subjected from the inside running over the surface in a substantially uniform manner and without pressure peaks, as would be the case, for example, with stiff supporting bodies. It is, thus, possible to change the shape of the outer inflatable body without this resulting in edges or sharp points that, in the case of a shirt being fitted on the outer inflatable body, may lead to deformation and/or creases and, thus, to a relatively poor pressing result.

The surface pressure to which the outer inflatable body is subjected by an inner inflatable body may be influenced by the shaping of the inner inflatable body and the pressure to which the latter is subjected. The supporting framework, here, is disposed such that, regardless of the size of the inner inflatable body and its configuration on the inside of the outer inflatable body, it provides a supporting surface on which the inner inflatable body can be supported.

The different pressures in the inner inflatable body and in the outer inflatable body can be achieved in different ways. In the simplest case, it is conceivable to have two separate air supplies with, in each case, one fan. In such a case, however, it is possible for the two impellers to be driven by a common motor. It is also conceivable to have a cascading configuration, in which a first fan inflates the outer inflatable body, in the interior of which air is taken in by a second fan, further compressed and directed into the inner inflatable bodies. Such a configuration results in the total pressure from both fans prevailing in the outer inflatable body. Here too, a common motor may drive the two impellers, although it is also conceivable, in such a case and in the preceding case, to have separate motors for the two impellers. In accordance with another feature of the invention, it is also possible to use a fan that supplies the inner and outer inflatable bodies through separate lines, the line to the outer inflatable body having a restrictor. As a result, the pressure in the outer inflatable body is lower than in the inner inflatable body.

In accordance with a further feature of the invention, the inner inflatable bodies with an air-permeable enclosure are inflated by a single fan, the outer inflatable body being inflated exclusively by the air flowing through the air-permeable enclosure of the inner inflatable body. In such a case, it is possible to determine the pressures in the inner and outer inflatable bodies in the stationary state by way of the fan and the air permeability of the inner and outer inflatable bodies.

In accordance with an added feature of the invention, the outer inflatable body is shirt-shaped and has a trunk section, the supporting framework is disposed within the trunk section and has sides and supporting surfaces on the sides, and the at least one inner inflatable body is a plurality of inner inflatable bodies, one of the inner inflatable bodies being respectively disposed between the supporting surfaces and a respectively opposite lateral portion of the trunk section, and, in an inflated state of the inner inflatable bodies, tensioning the trunk section in a direction of the sides.

In the case of two inner inflatable bodies being disposed on the sides of the trunk section of the outer inflatable body, each beneath a sleeve section, it is possible to achieve a flat form for the trunk region. This is considerably more in line with the cut that is customary for shirts so that it is possible to achieve a better pressing result without creases. In such a case, the pressure distribution may, for example, be such that a pressure of from 4 to 6 mbar prevails in the two laterally disposed inner inflatable bodies, compared to a pressure of from 1 to 3 mbar in the outer inflatable body.

In accordance with an additional feature of the invention, the outer inflatable body has a substantially flat chest section defining a plane, the supporting surfaces have surface normals, and the surface normals are inclined in relation to the plane.

In accordance with yet another feature of the invention, the fan has an outlet opening, a second fan has an inlet opening and an outlet opening, the outer inflatable body is connected to the outlet opening of the fan, the inner inflatable body is connected to the outlet opening of the second fan; and the inlet opening of the second fan opens into the outer inflatable body.

In accordance with yet a further feature of the invention, the fan is a motor-driven fan communicating with the outer inflatable bag for inflating the outer inflatable bag and the second fan is a motor-driven second fan communicating with the inner inflatable bag for inflating the inner inflatable bag.

In accordance with yet an added feature of the invention, the fan has an outlet opening, the inner inflatable body has an air-permeable enclosure and is connected to the outlet opening of the fan, and the outer inflatable body has an air-permeable enclosure with no air-inlet opening and is inflated exclusively by air flowing out of the inner inflatable body through the enclosure of the inner inflatable body into the outer inflatable body.

In accordance with yet an additional feature of the invention, the fan has an inlet opening and an outlet opening, a second fan has an inlet opening and an outlet opening, the outer inflatable body is connected to the outlet opening of the fan, the inner inflatable body is connected to the outlet opening of the second fan, and the inlet openings of the fan and the second fan are connected to the environment and, during operation of the fan and the second fan, the second fan generates a pressure higher than the fan.

A heating device can be used to heat the air directed into the inner and outer inflatable bodies. As a result, it is possible for the shirts to be fitted onto the outer inflatable body when still damp and to be smoothed out and dried under tension, this making it possible to achieve a particularly good pressing result. The fans can have separate or shared heating devices.

In accordance with again another feature of the invention, the fan is adapted to be activated at discrete points in time.

In accordance with a concomitant feature of the invention, the second fan is adapted to be activated at discrete points in time.

Other features that are considered as characteristic for the invention are set forth in the appended claims.

Although the invention is illustrated and described herein as embodied in an apparatus for pressing shirts, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
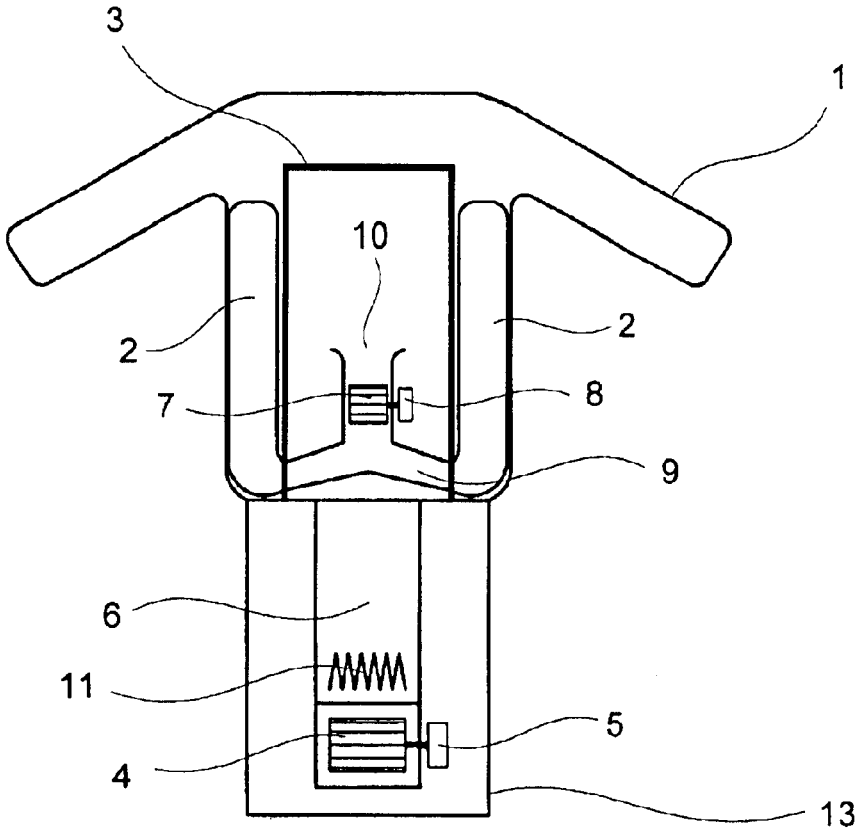
FIG. 1 is a vertical cross-sectional view from the front of a first embodiment of a shirt-pressing apparatus according to the invention.

Referring now to the figures of the drawings in detail and first, particularly to FIG. 1 thereof, there is shown a shirt-pressing apparatus having a bottom part 13, in which a fan 4 driven by a motor 5 is disposed within an air channel 6. A heating device 11 is disposed in the air channel 6 downstream of the fan 4, as seen in the flow direction. The air channel 6 opens out at the top into an outer inflatable body 1, which is fastened on the bottom part 13. Furthermore, a supporting framework 3, which is fixed to the bottom part 13, is disposed within the outer inflatable body 1. The supporting framework 3 is in the form of a rectangular frame and extends substantially over the entire height of the trunk section of the outer inflatable body 1. It is also possible for the frame to have a different, for example, arcuate, configuration. The two sides of the supporting framework 3 are located in each case in the vicinity of the respectively opposite lateral outer region of the trunk section. In such a case, the side surfaces of the supporting framework 3 form supporting surfaces on which inner inflatable bodies 2 can be supported, the latter being disposed on both sides of the supporting framework 3, between the supporting surfaces thereof and the outer inflatable body.

The two inner inflatable bodies 2 each have a bottom air inlet, the air inlets of the inner inflatable bodies 2 being connected to an air channel 9, in which a fan 7 driven by a motor 8 is disposed and the inlet 10 of which opens out into the interior of the outer inflatable body 1.

The supporting framework 3 and the inner inflatable bodies 2 are dimensioned such that, in the inflated state, the inner inflatable bodies 2 are supported on the supporting framework 3 and can force the side regions of the trunk section of the outer inflatable body 1 to the side, in which case, a flat cross-section of the trunk region can be achieved.

For the purpose of pressing a shirt, the shirt is fitted onto the outer inflatable body 1, in particular, when damp and fixed at the front, on the button strip or buttonhole strip, with a button-strip clamp 14. The two fans 4, 7 are, then, actuated by the motors 5, 8, and the heating device 11 is switched on. The outer inflatable body 1, here, is inflated by a pressure of from approximately 1 to 3 mbar, the fan 7 increasing this pressure to approximately 4 to 6 mbar and directing it into the inner inflatable bodies. The outer inflatable body 1, as such, tensions the shirt that is to be pressed, the trunk section of the latter being tensioned laterally by the pressure of the inner inflatable bodies 2. The enclosures of the inner inflatable bodies 2 and of the outer inflatable body 1 are air-permeable. As a result, the air heated by the heating device 11 can flow through, and dry, the shirt that is to be pressed. The shirt is pressed under the action of heat and tension.

Figure 2:
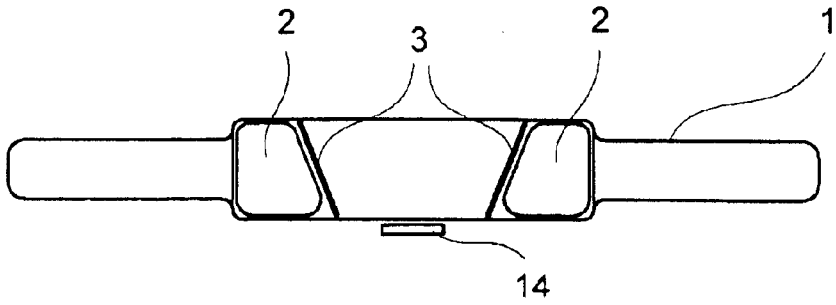
FIG. 2 is a horizontal cross-sectional view through the shirt-pressing apparatus of FIG. 1.

FIG. 2 illustrates the button-strip clamp 14, which is disposed in front of the chest region of the outer inflatable body 1 and serves for fixing the button strip or buttonhole strip of a shirt that has been fitted on the outer inflatable body. It can also be seen from FIG. 2 that those side surfaces of the supporting framework 3 on which the inner inflatable bodies 2 are supported are turned somewhat in the forward direction. As a result, the pressure exerted by the inner inflatable bodies 2, rather than being directed perpendicularly outward, is also directed somewhat forward in the direction of the button-strip clamp 14. This makes it possible to compensate for the button-strip clamp 14 influencing the shape of the outer inflatable body 1 in a disadvantageous manner. Without such compensation, the sleeve sections would be deflected rearward by the outer inflatable body 1 being subjected to the pressure of the button-strip clamp 14 from the front, which would result in an impairment of the pressing result.

Turning the side surfaces of the supporting framework 3 in the forward direction achieves the situation where the inner inflatable bodies 2 force the outer inflatable body 1 forward against the button-strip clamp 14 and the sleeve sections of the outer inflatable body 1 are located in a single plane with the trunk section. This results in a lower level of deformation within the shirt that is to be pressed, and, thus, in a better pressing result.

Figure 3:
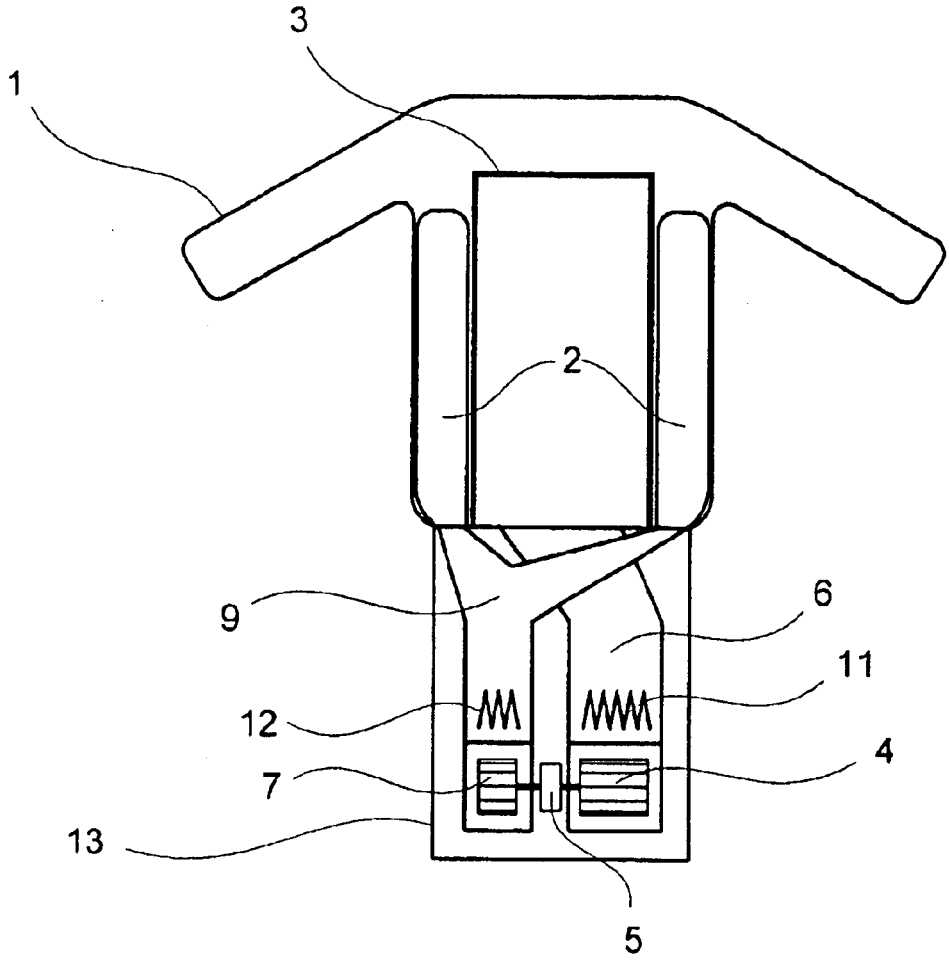
FIG. 3 is a vertical cross-sectional view from the front of second embodiment of the shirt-pressing apparatus of FIG. 1.

The embodiment illustrated in FIG. 3 only differs from that illustrated in FIG. 1 insofar as the fan 7, for inflating the inner inflatable bodies 2, takes in the air from the surroundings. In such a case, the air taken in has not been precompressed, as in the previous exemplary embodiment, with the result that the fan 7 has to achieve a higher pressure than the fan 4 for inflating the outer inflatable body 1. Because the air taken in by the fan 7 has not already been heated, as in the previous case, the fan 7 is associated with a second heating device 12.

To reduce the necessary outlay, the two fans 4, 7 are driven by a single motor 5. The pressure conditions prevailing in this exemplary embodiment may be set by the selection of the air permeability of the inner inflatable bodies 2 and of the outer inflatable body 1 and by the configuration of the fans 4, 7 and the design of the motor 5.

In the case of both exemplary embodiments, the inner inflatable bodies 2 are, advantageously, inflated by approximately 4 to 6 mbar and the outer inflatable body 1 is, advantageously, inflated by approximately 1 to 3 mbar.

We claim:

1. An apparatus for pressing shirts, comprising:

a flexible outer inflatable body;

a fan communicating at least with said outer inflatable body for inflating said outer inflatable body at a given pressure;

a supporting framework; and at least one inner inflatable body:

being disposed within said outer inflatable body;

being inflated at a pressure higher than said given pressure in an inflated state of said at least one inner inflatable body;

being disposed between said supporting framework and a section of said outer inflatable body; and in an inflated state, being supported against said supporting framework and, in said inflated state, subjecting a section of said outer inflatable body to pressure from inside said outer inflatable body.

2. The apparatus according to claim 1, wherein:

said outer inflatable body is shirt-shaped and has a trunk section;

said supporting framework is disposed within said trunk section and has sides and supporting surfaces on said sides; and said at least one inner inflatable body is a plurality of inner inflatable bodies, one of said inner inflatable bodies being respectively disposed between said supporting surfaces and a respectively opposite lateral portion of said trunk section, and, in an inflated state of said inner inflatable bodies, tensioning said trunk section in a direction of said sides.

3. The apparatus according to claim 2, wherein:

said outer inflatable body has a substantially flat chest section defining a plane;

said supporting surfaces have surface normals; and said surface normals are inclined in relation to said plane.

4. The apparatus according to claim 1, wherein:

said fan has an outlet opening;

a second fan has an inlet opening and an outlet opening;

said outer inflatable body is connected to said outlet opening of said fan;

said inner inflatable body is connected to said outlet opening of said second fan; and said inlet opening of said second fan opens into said outer inflatable body.

5. The apparatus according to claim 4, wherein:

said fan is a motor-driven fan communicating with said outer inflatable bag for inflating said outer inflatable bag; and said second fan is a motor-driven second fan communicating with said inner inflatable bag for inflating said inner inflatable bag.

6. The apparatus according to claim 1, wherein:

said fan has an outlet opening;

said inner inflatable body has an air-permeable enclosure and is connected to said outlet opening of said fan; and said outer inflatable body has an air-permeable enclosure with no air-inlet opening and is inflated exclusively by air flowing out of said inner inflatable body through said enclosure of said inner inflatable body into said outer inflatable body.

7. The apparatus according to claim 1, wherein:

said fan has an inlet opening and an outlet opening;

a second fan has an inlet opening and an outlet opening;

said outer inflatable body is connected to said outlet opening of said fan;

said inner inflatable body is connected to said outlet opening of said second fan; and said inlet openings of said fan and said second fan are connected to the environment and, during operation of said fan and said second fan, said second fan generates a pressure higher than said fan.

8. The apparatus according to claim 1, wherein said fan has a heating device.

9. The apparatus according to claim 4, wherein said second fan has a heating device.

10. The apparatus according to claim 1, wherein said fan is adapted to be activated at discrete points in time.

11. The apparatus according to claim 4, wherein said second fan is adapted to be activated at discrete points in time.

* * * * *